US011575200B2

(12) United States Patent
Rojanski

(10) Patent No.: US 11,575,200 B2
(45) Date of Patent: Feb. 7, 2023

(54) CONFORMAL ANTENNA

(71) Applicant: ISRAEL AEROSPACE INDUSTRIES LTD., Lod (IL)

(72) Inventor: Vladimir Rojanski, Petach Tikva (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 0 days.

(21) Appl. No.: 17/264,081

(22) PCT Filed: Aug. 1, 2018

(86) PCT No.: PCT/IL2018/050855

§ 371 (c)(1),
(2) Date: Jan. 28, 2021

(87) PCT Pub. No.: WO2020/026220

PCT Pub. Date: Feb. 6, 2020

(65) Prior Publication Data

US 2021/0313686 A1 Oct. 7, 2021

(51) Int. Cl.
*H01Q 3/30* (2006.01)
*H01Q 1/36* (2006.01)

(52) U.S. Cl.
CPC ..... *H01Q 3/30* (2013.01); *H01Q 1/36* (2013.01)

(58) Field of Classification Search
CPC ..... H01Q 1/36; H01Q 1/28; H01Q 1/281; H01Q 1/286; H01Q 3/30; H01Q 3/38; H01Q 3/36; H01Q 21/067; H01Q 11/205; H01Q 13/085
See application file for complete search history.

(56) References Cited

U.S. PATENT DOCUMENTS 3,110,030 A 11/1963 Cole
3,699,574 A * 10/1972 O'Hara ..... H01Q 3/242 342/154
4,108,400 A 8/1978 Groutage et al.
(Continued)

FOREIGN PATENT DOCUMENTS

CN 103022726 A 4/2013
CN 103457023 A 12/2013
(Continued)

*Primary Examiner* — Thai Pham
(74) *Attorney, Agent, or Firm* — Dorsey & Whitney LLP

(57) ABSTRACT

An antenna device is presented comprising: a conformal antenna body which has a desired geometry corresponding to a front portion of a platform on which the antenna device is to be mounted, and an antenna unit carried by the antenna body. The antenna unit comprises at least one phased array of antenna elements, the antenna elements of each of the at least one array being arranged in a spaced-apart relationship in a closed loop path along a circumference of the antenna body having a desired geometry corresponding to the front portion of the platform on which the antenna unit is to be mounted. Each of the antenna elements is configured as an end-fire antenna element capable of emitting linearly polarized radiation. The array of the antenna elements is operable as a forward looking end-fire antenna array, enabling electronic steering of an antenna beam by controllably modifying phases of the antenna elements of each array.

19 Claims, 8 Drawing Sheets

(56) References Cited

U.S. PATENT DOCUMENTS

| | | | | |
|---|---|---|---|---|
| 4,384,290 | A * | 5/1983 | Pierrot | G01S 13/74 244/3.19 |
| 5,220,330 | A | 6/1993 | Salvail et al. | |
| 5,874,915 | A * | 2/1999 | Lee | H01Q 3/242 342/375 |
| 6,768,456 | B1 | 7/2004 | Lalezari et al. | |
| 6,774,848 | B2 | 8/2004 | Wright | |
| 6,784,838 | B2 | 8/2004 | Howell | |
| 7,532,170 | B1 | 5/2009 | Lee et al. | |
| 8,594,735 | B2 * | 11/2013 | Huang | H01Q 25/00 455/562.1 |
| 9,000,982 | B2 | 4/2015 | Chethik et al. | |
| 9,118,112 | B1 * | 8/2015 | West | H01Q 1/28 |
| 2004/0263387 | A1 * | 12/2004 | Lalezari | H01Q 25/02 342/373 |
| 2008/0191950 | A1 | 8/2008 | Chang et al. | |
| 2012/0181374 | A1 | 7/2012 | Williams | |
| 2018/0166779 | A1 * | 6/2018 | Feria | H04B 7/18573 |
| 2020/0176889 | A1 * | 6/2020 | Rojanski | H01Q 3/38 |

FOREIGN PATENT DOCUMENTS

| | | | |
|---|---|---|---|
| CN | 106428522 | A | 2/2017 |
| DE | 2732627 | A1 | 2/1979 |
| EP | 0250082 | A3 | 3/1990 |

* cited by examiner

CONFORMAL ANTENNA

TECHNOLOGICAL FIELD AND BACKGROUND

The present invention is in the field of conformal antennas. Conformal antennas are designed to conform or follow a certain specific shape of a surface on which the antenna is to be mounted, typically a curved surface. Conformal antennas are used in aircrafts (civilian or military), ships, land vehicles, including also train antennas, car radio antennas, and cellular base station antennas. The use of conformal antennas in such devices provides to save space and also to make the antenna less visually intrusive by integrating it into existing objects.

Conformal antennas typically utilize a phased array of antenna elements, where each antenna element is driven by a controlled phase shifter, to provide directionality of radiation pattern of the antenna. Hence, the antenna can transmit radiation mainly in a prescribed direction (particular target zone), and be sensitive to the signal from the particular target while rejecting interfering signals from other directions. In a conformal antenna, the antenna elements are mounted on a curved surface, and therefore the phase shifters operate to compensate for the different phase shifts caused by the varying path lengths of the radiation waves due to the location of the individual antenna elements on the curved surface.

GENERAL DESCRIPTION

There is a need in the art for a novel configuration of a conformal antenna unit, which can be placed at the front end of platforms and is capable of providing maximal performance in a generally forward-looking direction relative to the platform nose, as well as electronic steering of the antenna beam within a wide angular range, for a wide range of frequencies (e.g. 10%-30% band width with respect to the central frequency).

In particular, there is need for such antenna which can be placed on platforms having relatively small cross sectional size (diameter), e.g. of about 3-6 wavelengths. In this connection, it should be noted that the conventional approach of conformal antenna configuration makes it difficult, if not impossible, to use such antenna at the small-diameter front end of the platform. This difficulty is associated with a need to deal with a small-diameter conformal antenna and radome effects on the antenna beam.

A conventional conformal antenna with electronic steering property typically has an antenna boresight substantially perpendicular to the antenna surface (i.e. to the surface of the platform carrying such conformal antenna). Antenna boresight is the axis of maximum gain (maximum radiated power) of a directional antenna, and for most antennas the boresight is the axis of symmetry of the antenna. Phased array antennas can electronically steer the antenna beam, changing the angle of the boresight by shifting the relative phase of radiation emitted by different antenna elements. For conformal antennas with generally forward-looking direction, the wide angular range of antenna beam steering is required, i.e. about 70-90 degrees, which significantly affects the antenna performance. Further, conventional conformal antenna allows only partial space coverage, usually around the side of the platform on which such antenna is placed. Even if the antenna is almost spherical, different groups of antenna elements are involved for operation in different space segments. Hence, in order to increase the space coverage up to 360 degrees around the platform, two or more antenna are used each for operating in a space segment, which complicates the entire antenna system and makes it more expensive.

The present invention provides a novel conformal antenna unit, which solves that above described problem of limited operational volume (space coverage) of the conventional antennas, which is more critical for the use of antenna at the front end of the platform for generally forward-looking direction of the antenna.

The antenna unit of the invention is configured and operable as an end-fire traveling wave antenna. The antenna unit includes at least one phased array of end-fire antenna elements. The antenna elements of the array are arranged in a spaced-apart relationship along at least a portion of the circumference of the platform carrying the antenna, or preferably along a closed-loop circumferential path conforming the circumference of the platform carrying the antenna. The antenna unit may include more than one such phased arrays arranged concentrically in a spaced-apart relationship along a longitudinal axis of the platform.

The antenna elements of the array may be equally spaced from one another along the circumferential path. Considering a substantially cylindrical or generally conical geometry of the front portion of the platform, on which the antenna is placed, the antenna array(s) are appropriately spaced from the front end (cone tip/apex).

The number N ($N \geq 2$) of the antenna elements in the array is appropriately selected in accordance with the platform diameter (generally, cross-sectional dimension) at the respective location of the array with respect to the front end (tip) of the platform and the required distance between the adjacent antenna elements in the array. It should be understood that the larger the number N of the antenna elements in the array, the higher is the gain and the steering angle of the array, as well as the better control of the radiation pattern of the array with regard to sidelobes' arrangement.

Considering multiple antenna arrays spaced from one another along the longitudinal axis of the platform of the conical geometry, the number of the elements in the array increases with the array's distance from the cone tip. It should also be understood that the larger the number M of such spaced-apart arrays, the higher is the gain and better is the radiation pattern of the antenna, for a given steering angle of the antenna operation.

Each of the antenna elements emits radiation of linear polarization. Phases of the antenna elements of the array are controlled in accordance with the required angular direction of the antenna beam of the entire array. For the forward direction operation of the antenna (substantially zero-steering), a phase shift, $\Delta\varphi=\varphi_i-\varphi_{i+1}$, between the phases of $i^{th}$ and $(i+1)^{th}$ neighboring antenna elements in the array of n antenna elements is determined as $\Delta\varphi=2\pi/n$. For example, for 8-element array, the phase shift between two sequential antenna elements in the direction along the circular path is 45 degrees, and for the 16-elements array, the phase shift is 22.5 degrees. For small-angle steering, i.e. from zero to about 40 degrees of angular range of steering, phases of the antenna elements are shifted/controlled to be substantially the same for circular polarization. For relatively large-angle steering, e.g. angular range higher than 40 degrees, the phases of all the elements in the array are controlled to be substantially the same for arbitrary linear polarization.

As will be described more specifically further below, a need for such a phase shift between the successive antenna elements is associated with the fact that in the antenna configuration of the invention, each antenna element is an end-fire type antenna, namely the antenna element boresight (the axis of maximum gain of the antenna element) is substantially parallel to the surface of antenna element or, in other words, substantially along the axis an elongated antenna element, rather than perpendicular to it. The polarization components of the radiation emitted by the antenna element are perpendicular to the boresight direction. Hence, in order to provide boresight of the antenna array in the desired direction while effectively utilizing the radiation emitted by all the antenna elements in the array, the above-described phase shift between the successive elements is controllably maintained.

As also will be described further below, with the above-described configuration of the phased array(s) of antenna elements, the antenna elements may be placed on/incorporated in a metallic body/surface, preferably such that the antenna array(s) is/are spaced from the front end (tip) of the platform by a metallic tip (cinder or cone, as the case may be) which actually operates as a radiating element, positively contributing to the antenna radiation pattern. The longitudinal dimension of the front end portion or tip portion, i.e. a distance from the tip to the antenna array (1st antenna array), as well as such geometrical parameters as a distance between the antenna elements in the array, and a distance between the adjacent arrays (if more than one array is used), are appropriately selected in accordance with an operational frequency band of the antenna and the geometry/dimension of the conical platform on which the antenna is to be mounted.

It should be noted that the antenna elements of different arrays may be different in geometry (i.e. lateral dimension and/or thickness and/or length). The geometrical parameters of the antenna elements of the different arrays may be optimized to enable the antenna operation with higher steering angles. For example, proper selection of such parameters provides for optimizing coupling between all the antenna elements to optimize (increase) the steering angles, which is more expressive when arranging the antenna elements of multiple arrays on a platform portion having a conical body; and proper variation of the size of the antenna element to optimize the coupling is more essential for the case of a tubular body of the platform portion carrying the antenna.

Additionally or alternatively to the optimization of the geometry of the antenna elements, the number of arrays, and the number(s) of elements in the array(s), the coupling between the antenna elements can be further optimized/controlled by arranging the antenna elements of the adjacent arrays in a chess-like fashion. This also allows for decreasing a gap between such arrays.

Further, it should be noted that in order to even more increase the steering angle of the antenna up to 90° or higher (up to 150°), one or more additional antenna elements can be provided on the platform body configured with a boresight substantially perpendicular to the longitudinal axis of the platform body. For example, this may be a ring-like antenna or an array of two or more discrete controllably switchable phased arrays of antenna elements.

The antenna device may also include phase sifter circuits, which may be analogue or digital circuits.

In some embodiments, the platform, in addition to the above-described antenna device, may include one or more additional sensors which may be optical and/or RF sensors. This would add additional frequency channel(s) to the entire sensing system.

Thus, according to an aspect of the invention, it provides an antenna device comprising: a conformal antenna body which has a desired geometry corresponding to a front portion of a platform on which the antenna device is to be mounted, and at least one antenna unit carried by the antenna body, said at least one antenna unit comprising at least one phased array of antenna elements, the antenna elements of the array being arranged in a spaced-apart relationship in a closed loop path along a circumference of the antenna body having a desired geometry corresponding to a front portion of platform on which the antenna unit is to be mounted, each of the antenna elements of said at least one antenna unit is configured as an end-fire antenna element capable of emitting linearly polarized radiation, the array of the antenna elements being thereby operable as a forward looking end-fire antenna array, enabling electronic steering of an antenna beam by controllably modifying phases of the antenna elements of the array.

The antenna body may be of a substantially cylindrical shape or substantially conical shape or substantially spherical shape. The antenna unit is spaced a predetermined distance from a base region of the cylindrical antenna body or apex region of the conical antenna body. Such "base region" or "apex region" is at times referred to hereinbelow as a tip portion/end of the body. The antenna body may be made of a metallic material.

Generally, the antenna body of a conformal antenna of the present invention may be of any required geometry, and the arrangement of antenna array(s) on the body may be of any suitable configuration. For example, the antenna body may be of a conical geometry, or of a tubular like geometry; or may have a distal portion of a conical-like geometry and a proximal portion of a tubular-like geometry. In the latter configuration, the antenna elements may be located within the distal portion and/or the proximal portion.

It should be noted that, although in the description below the "closed-loop path" is at times referred to as a "circular path", the invention is not limited to a circular cross section of the antenna body, and this expression should therefore be interpreted broadly, covering any curved-surface geometry of the antenna body, e.g. circular, oval-like, polygonal, as well as geometry of varying cross-sectional shape and/or dimension.

As described above, the antenna elements in the antenna array may be equally spaced from one another along the closed loop path. The antenna unit may comprise two or more antenna arrays arranged in a spaced-apart relationship along the antenna body. The different antenna arrays may include the same number of antenna elements; or may include arrays having different number of antenna elements. As also described above, the antenna elements of different arrays may or may not have the same geometry, and such geometrical parameters are properly selected to optimize the performance of the antenna device.

The antenna device further includes a phase controller circuit for controlling phases of all the antenna elements in each antenna array to provide a desired boresight of the antenna array in accordance with a selected radiation direction. The phase controller is configured and operable for providing a predetermined phase pattern of the antenna array resulting in a circular polarization of the antenna radiation of said antenna elements. Such phase pattern may be such that the phases of the antenna elements in the array are shifted one with respect to the other along a circular direction, such that each successive antenna element in said direction has a phase shifted by a predetermined value with respect to a preceding antenna element.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
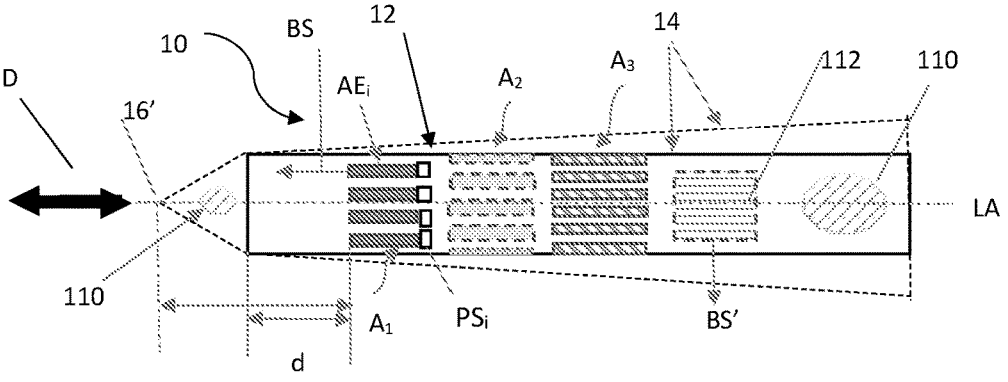
FIG. 1A is a schematic illustration of an antenna device of the present invention.

Referring to FIG. 1A, there is schematically illustrated, by way of a bock diagram, an example of an antenna device 10 of the present invention. The antenna device 10 includes at least one conformal antenna unit—one such antenna unit 12 being exemplified in the figure—mounted on a supporting antenna body 14 having a curved surface corresponding to that of a platform on which the antenna device is to be mounted.

As exemplified in the figure, the antenna body 14 is an elongated body having a substantially tubular or substantially conical geometry, or having a substantially conical distal portion and a substantially tubular proximal portion. It should, however, be understood that the invention is not limited to any specific geometry of the curved surface carrying the antenna unit(s). The antenna unit 12 includes a plurality of antenna elements, generally at $AE_i$, which are arranged in one or more antenna arrays spaced from one another along a longitudinal axis of the body 14—three such antenna arrays $A_1$, $A_2$, and $A_3$ being shown in the non-limiting example of FIG. 1. The antenna elements of each array are arranged in a spaced apart relationship along a closed-loop path (e.g. circular path).

The antenna device 10 of the invention is particularly useful for placing the antenna unit 12 on a front portion 16 of a platform and is configured and operable for operating in a so-called "forward-looking mode", namely having a general forward-looking radiation direction D with an ability to be electronically steered within a wide angular range around this general radiation direction. As will be described more specifically further below, the antenna unit 12 is located at a predetermined distance d from a base or tip end 16' of the platform body. Such distance d may be of about 2λ or higher, where λ is the operation wavelength of the antenna device.

Each antenna element $AE_i$ is configured as an end-fire antenna element capable of emitting linearly polarized radiation. The array of the antenna elements is thus operable as a forward looking end-fire antenna array. This enables electronic steering of an antenna beam by controllably modifying phases of the antenna elements of each array.

The construction and operation of the end-fire antenna element are generally known and do not form part of the present invention. An example of an end-fire antenna element suitable to be used in the antenna device of the present is described further below with reference to FIG. 3.

As also schematically shown in the figure, each antenna element $AE_i$ is associated with its own operational module including a phase shifter $PS_i$. The construction and operation of the operational module of the antenna element implanting the phase shifting technique will be exemplified further below with reference to FIGS. 3A and 3B.

As described above, the antenna unit of such end-fire antenna elements with their boresight BS (being the axis of maximum gain of the antenna element) substantially parallel to the surface of the antenna element, may generally include M antenna arrays (M≥1); the antenna array may include number N (N≥2) of the antenna elements arranged in a spaced-apart relationship along a closed-loop circumferential path. The number of antenna elements, as well as their geometry, in the arrays may or may not be the same. As exemplified in FIG. 1A, the antenna elements of two adjacent arrays $A_1$ and $A_2$ may be arranged in a chess-like fashion.

As further exemplified in FIG. 1A, in dashed curves, the antenna device 10 may include an additional antenna unit 112, in order to increase the steering angle of the entire antenna device 10 up to 150°. Such additional antenna unit 112 includes antenna elements (arranged in one-multi-array fashion) having boresight BS' substantially perpendicular to the longitudinal axis LA of the platform body. It should be noted, although not specifically shown, that such additional antenna unit 112 may include a ring-like antenna or an array of two or more discrete controllably switchable phased arrays of antenna elements.

Also, as exemplified in FIG. 1A, at least one additional sensor device 110 may be provided of any suitable known type, including optical and/or RF sensor elements. The sensor device(s) 110 may generally be located at any suitable site(s) of the antenna body 14, e.g. upstream of the antenna unit 12 and possibly also downstream thereof. Such sensor device(s) 110 together with the antenna device 10 form a sensing system, in which the sensor device(s) 110 add(s) additional frequency channel(s) to that/those of the antenna device 10.

Figure 1B:
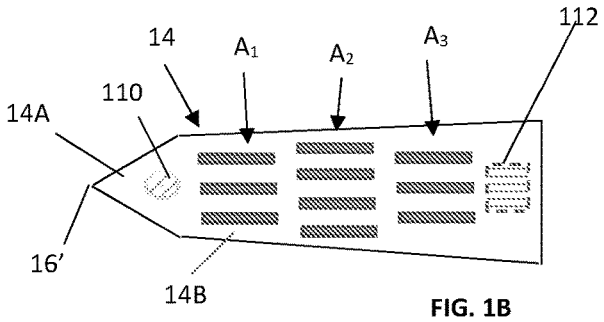
FIGS. 1B to 1E show more specifically four examples, respectively, for the configuration of the antenna body and arrangement of antenna elements suitable to be used in the antenna device of the present invention.
Figure 1C:
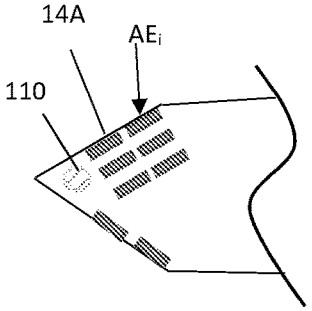
Figure 1D:
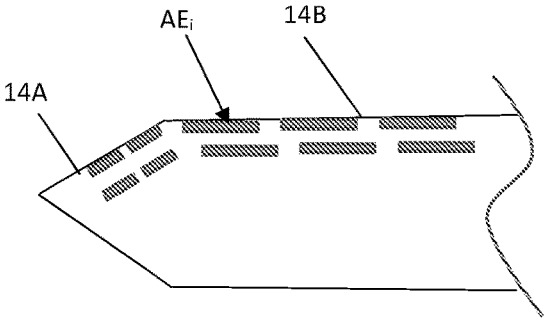
Figure 1E:
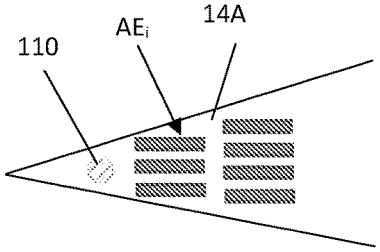

FIGS. 1B to 1E show a few more specific, but not limiting examples, of the arrangement of antenna element of the antenna unit 12 on the antenna body 14. To facilitate illustration and understanding, the same reference numbers are used to indicate components that are common in all the examples of the invention. In the example of FIGS. 1B, 1C and 1D, the antenna body 14 has a distal portion 14A of a substantially conical geometry and a proximal portion 14B of a substantially tubular geometry. In the example of FIG. 1B, the antenna unit 12, which may for example include more than one array of antenna elements (three arrays in this non-limiting example) is located on the proximal portion 14B. As shown, additional antenna array 112 may optionally be provided as described above, and also optionally the additional sensor(s) 110 may be provided. In the example of FIG. 1C, the antenna elements of the antenna unit 12 are located at the distal conical portion 14A. Optionally, sensor device 110 and/or the additional antenna unit 112 may be provided on the antenna body 14. In the example of FIG. 1D, the antenna elements of the antenna unit 12 are distributed on both the distal conical and proximal tubular portions 14A and 14B Similarly, devices 110 and/or 112 (which is not shown here) may or may not be used. In the example of FIG. 1E, the antenna body 14 has a conical configuration, and the antenna elements of the antenna unit 12 are appropriately arranged in one or more arrays on the antenna body. Although not specifically shown, additional antenna unit(s) and sensor(s), such as antenna unit 112 and sensor 110 described above may be used.

It should also be noted, although not specifically shown in FIGS. 1B-1E, for the purposes of the present application, each antenna element is associated with its operational module including the phase shifter utility/circuit.

Further, it should be understood that in all the above examples, the antenna unit 12 is located at a certain predetermined distance from the base/tip 16' of the antenna body 14 or that of the platform 16 on which the antenna device is mounted.

Figure 2A:
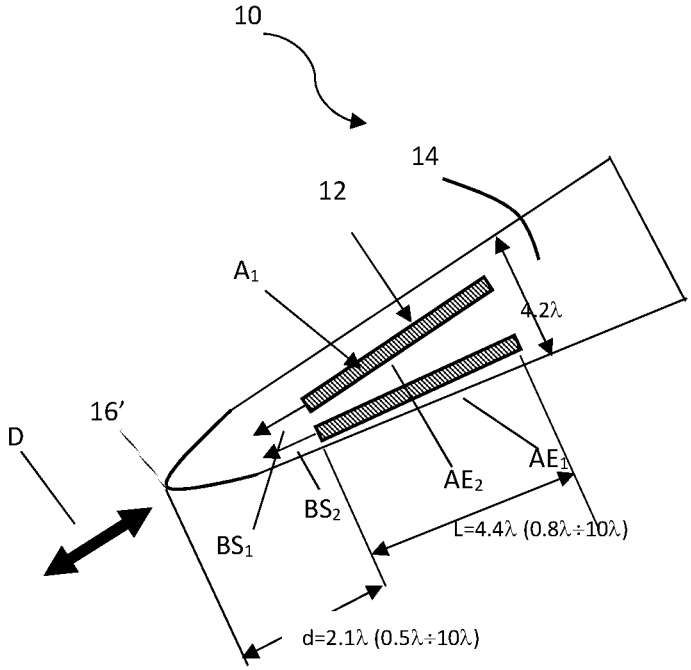
FIGS. 2A and 2B schematically illustrate an example of a specific configuration of the antenna device of the present invention.
Figure 2B:
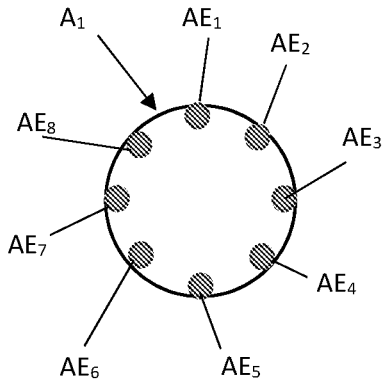
Figure 2C:
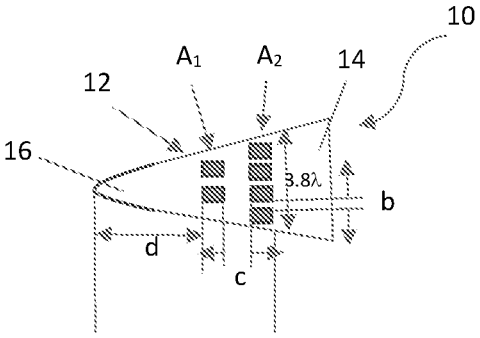
FIG. 2C is a schematic illustration of another possible example of the antenna device of the present invention.

Reference is now made to FIGS. 2A-2B and 2C showing two more specific but not limiting examples of an antenna device 10 of the present invention utilizing two different configurations of the antenna unit 12.

In both examples of FIGS. 2A-2B and FIG. 2C, the antenna device 10 includes a conformal antenna unit 12 mounted on a supporting antenna body 14 having a curved surface corresponding to that of a platform on which the antenna device is to be mounted. In these examples, the antenna body 14 has a substantially conical geometry. As indicated above, the invention is not limited to any specific geometry of the curved surface carrying the antenna unit, in which the antenna elements are arranged in one or more circular antenna arrays, i.e. antenna elements are arranged in a spaced apart relationship along one or more closed-loop paths.

The antenna device 10 is configured and operable for operating in the "forward-looking mode", with a general forward-looking radiation direction D and ability to be electronically steered within a wide angular range around this general radiation direction. In the example of FIGS. 2A-2B the antenna unit 12 includes one phased array $A_1$, and in the example of FIG. 2 the antenna unit 12 includes two phased arrays $A_1$ and $A_2$.

As described above, the principles of the invention are not limited to a number of phased arrays of antenna elements, as well as are not limited to number(s) of the antenna elements in the array(s). Thus, generally, the antenna unit 12 may include m antenna arrays, m≥1, such that in case of multiple antenna arrays they are located in a spaced-apart relationship along the longitudinal axis LA of the body 14, and each of the antenna arrays includes multiple antenna elements located in a spaced-apart relationship along a circumferential path, with the same or different numbers of antenna elements in the arrays. In these specific examples, where the antenna body 14 has a substantially conical geometry, the number of the elements in the arrays increases with the $1^{st}$ array's distance d from a cone tip/apex 16'. For example, the antenna array $A_1$ (which is the single array in the example of FIGS. 2A-2B, and is the first array located closer to the tip portion 16' in the example of FIG. 2C) has eight antenna elements $AE_1$-$AE_8$, and in the second antenna array $A_2$ in the example of FIG. 2C, located farer from the tip portion 16' includes sixteen antenna elements. In the specific not limiting example of FIG. 2A, the antenna unit 12 is spaced from the tip 16' distance d=2.1λ, the antenna element is of the length l=4.4λ, where λ is the operational wavelength of the antenna. Generally, such parameters as d and l may be in the ranges of 0.5λ-10λ, and 0.8λ-10λ, respectively.

The antenna elements of the same array are preferably equally spaced from one another. In case more than one antenna arrays are used, the distance between the antenna elements of one array may or may not be equal to the distance of the antenna elements in one or more other arrays. The number(s) of the antenna elements in the array(s) is/are selected in accordance with the dimensions and shape of the antenna body, i.e. of the platform, and frequency and gain requirements for the antenna operation, as well as the requirement for antenna radiation pattern (reduction/suppression of sidelobes).

The antenna body 14 may be a metallic body. The metallic tip portion 16 of the body contributes to the antenna radiation pattern. Such parameters as the longitudinal dimension d of the tip portion 16 (i.e. a distance of the antenna array from the tip 16' of the antenna body), as well as a distance b between the antenna elements in the array, and possibly also a distance c between the antenna arrays, are selected/optimized in accordance with the frequency and gain requirements for the antenna operation. For example, when higher operational frequencies are to be used, the distance d may be lower than that preferred for lower operational frequencies of the antenna device.

Each antenna element AE is an end-fire antenna element, whose boresight BS (shown in FIGS. 1A and 2A), being the axis of maximum gain of the antenna element, is substantially parallel to the surface of the antenna element.

Figure 3:
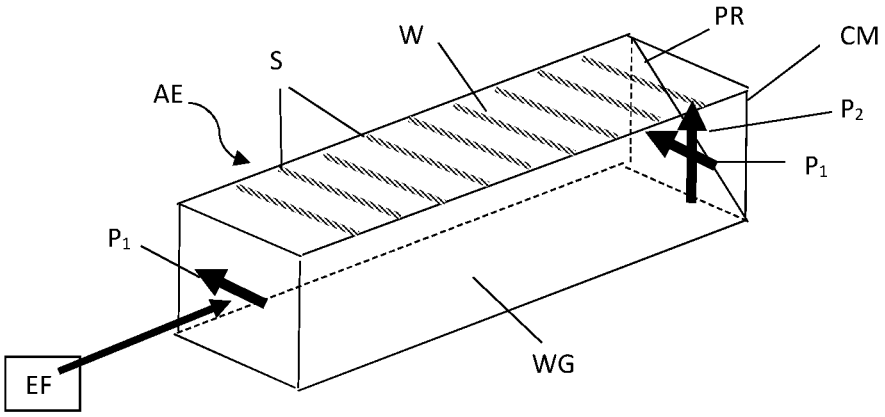
FIG. 3 schematically exemplifies an end-fire antenna element suitable to be used in the antenna device of the present invention.

Reference is made to FIG. 3 showing an example of the configuration of the end-fire antenna element AE suitable to be used in the present invention. The antenna element is configured as an end-fire waveguide WG dimensioned for propagating two orthogonal linearly polarized wave energy modes. A radiating wall W of the waveguide WG has a plurality of thin, narrow, radiating slots S, which are arranged in a spaced-parallel relationship along the radiating wall W and extend along an axis perpendicular to the longitudinal axis of the waveguide WG. The slots S are dimensioned (have a length) such that the slots are nonresonant with respect to the operating wavelength of the antenna element, and arranged with small gaps between them to form a leaky line. The gaps between the slots S and the electrical driving parameters determine the radiating beam angle, and the slot dimension affects the shape of the radiating beam. The radiating slots S are excitable by polarized electric fields EF (from a field source which is not specifically shown here) to excite linearly polarized electric fields EF within the slots having a plane of polarization P oriented along the slot axis (parallel to the wall W and perpendicular to the longitudinal axis of the wall W). At the opposite end of the waveguide is configured as a termination unit formed by a conductive facet CM of the waveguide WG and a diagonal member operable as a polarization rotator PR.

Linearly polarized wave propagates through the waveguide WG and excites the lowest order TE-mode in the waveguide with the plane of polarization of the waves being parallel to the wall W. The radiating slots S are excitable only by linearly polarized waves with the plane of polarization orthogonal to the wall W (or generally, selected plane dependent on the selected slots' arrangement). Hence, the wave energy mode excited by the electric field EM propagates along the waveguide WG without exciting the slots S (since currents induced into the waveguide wall W has no component transverse to the longitudinal axis of the slots S). At the facet CM with the polarization rotator PR, the plane of polarization is rotated by 90 degrees to be parallel with the selected plane, i.e. from plane of polarization $P_1$ to plane of polarization $P_2$; and the rotated linearly polarized wave is substantially reflected to propagate back along the waveguide WG. The reflected wave has the plane of polarization parallel to the selected plane and thus excites the slots similarly to that of the forward end-fire excitation. Thus, in this non-limiting example the end-fire beam is reversed with respect to the input EM propagated from the source and is forward with respect to the direction of the reflected electromagnetic wave.

It should, however, be understood that the present invention is not limited to the above-exemplified configuration of the end-fire antenna element, and any other known suitable configuration can be used, provided that the antenna element is configured and operable to produce a radiation beam whose axis is either parallel to the axis of the element or makes an angle with said axis other than 90 degrees, or in other words the radiation beam is not a boresight.

It should also be noted that, although nor specifically shown in FIG. 3, but as described above and schematically shown in FIG. 1A, for the purposes of the present invention each antenna element is associated with (i.e. includes or connected to) the operational module including the phase shifter utility PS.

Reference is now made to FIGS. 3A and 3B schematically illustrating the structural and operational principles of the antenna array, e.g. array $A_1$, for the forward-looking direction in the antenna unit 12 of the invention. As described above, the polarization components P of the radiation emitted by the antenna element AE are perpendicular to the boresight BS direction. Hence, in order to provide desired orientation of the boresight of the antenna array $A_1$ (to provide desired directional operation of the antenna), while effectively utilizing the radiation emitted by all the antenna elements in the array (i.e. maximizing the performance) for each required direction, the phases of the antenna elements in the array are appropriately controlled.

As shown schematically in FIG. 3A (and is also be relevant for all the previously described examples), each of the antenna elements AE in the antenna device has its associated operational module utilizing the phase sifter utility PS, and all the phase shifters are associated with (connectable to) a control system 200 which includes inter alia suitable a phase shifter controller 202, and an analyzer unit/module 204 configured and operable to analyze input data about the operational direction and generate corresponding phase control data with respect to each antenna element in each array and communicate corresponding control data pieces to the respective phase shifters PS. The phase shifters PS utilize this control data to adjust the phases for the antenna elements. If the antenna operation with relatively small-angle steering, angular range from zero to up to about 40 degrees, is needed, the phases of all the elements in the array are controlled to be substantially the same for each direction within this angular range for circular polarization of the beam. For the antenna operation with relatively wide-angle steering, i.e. angular range of about 40 degrees or higher, the phases of all the elements in the array are controlled to be substantially the same for each direction in this angular range for circular or arbitrary linear polarization of the beam.

Figure 4A:
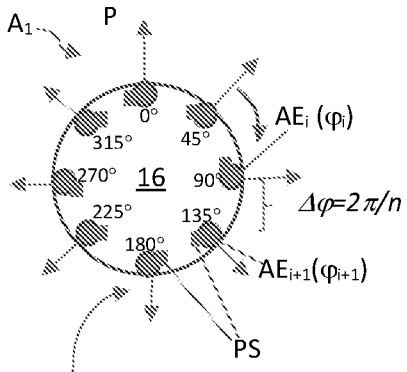
FIGS. 4A and 4B schematically illustrate the principles of a phase shift technique utilized in the present invention for the antenna device operation in a forward-looking direction.
Figure 4A:
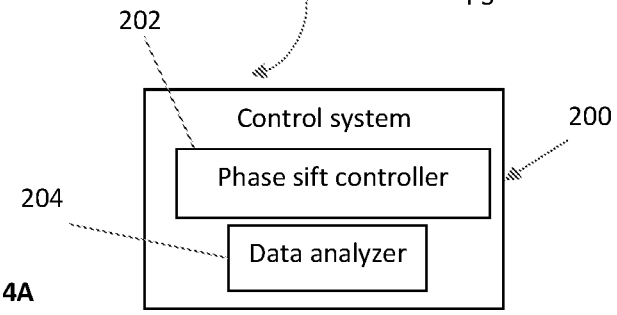

For substantially forward direction D, zero-steering from this direction, a phase, $\varphi_{i+1}$, of each successive antenna element $AE_{i+1}$ is shifted from the phase, $\varphi_1$, of the preceding antenna element $AE_i$ in a direction along the circular path (as shown in FIG. 4A) by the same value of the phase shift, $\Delta\varphi=\varphi_i-\varphi_{i+1}$, such that the antenna beam of the entire array $A_1$ is of circular polarization. A phase shift $\alpha\varphi$ between the phases of each two neighboring elements, considered as the successive elements in the direction along the circular path, in the array of n antenna elements is determined as $\Delta\varphi=2\pi/n$. For example, for 8-element array $A_1$, the phase shift $\Delta\varphi$ is 45 degrees, and for the 16-elements array $A_2$, the phase shift is 22.5 degrees.

Figure 4B:
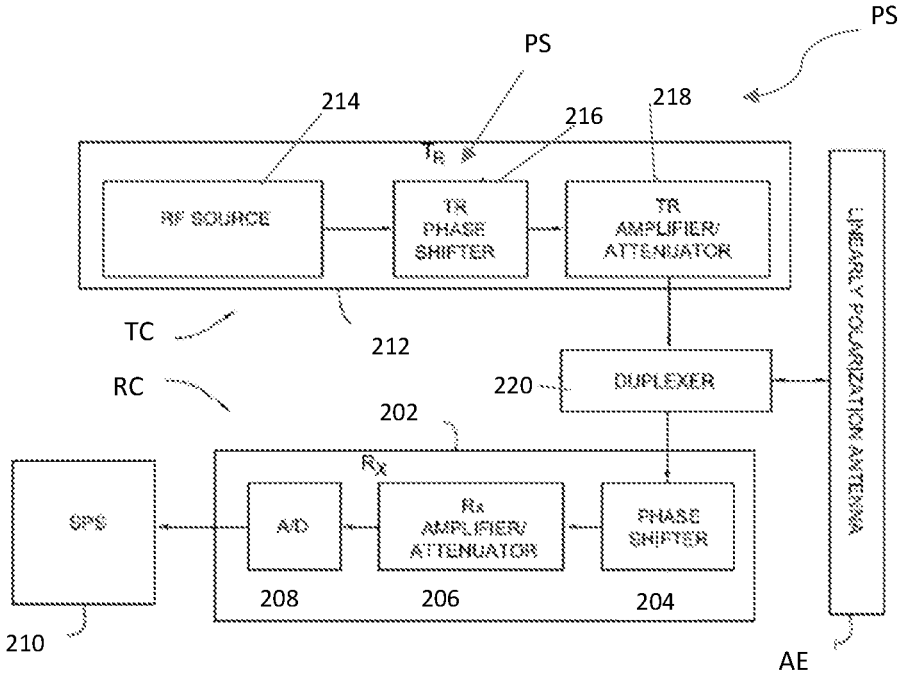

FIG. 4B exemplifies, by way of a block diagram, the configuration of the operational module 200 of the antenna element configured to implement the phase shifting technique. The operational module includes a receiving channel RC and a transmitting channel TC coupled to a linearly polarized end-fire antenna element AE (e.g. configured as described above with reference to FIG. 3). The receiving channel RC includes a receiver (Rx) 202 that includes a phase shifting circuit 204 of the phase shifter utility PS, a receiver amplifier/attenuator 206 and an analog-to-digital converter (ADC) 208. The receiving channel RC also includes a signal processing system (SPS) 210. In turn, the transmitting channel TC includes a transmitter ($T_R$) 212 that includes a source 214 of radio frequency (RF) radiation and a $T_R$ phase shifting element/circuit 216 of the phase shifter utility PS configured to provide required phase shifts to the signals provided by the RF source 214. Further, the transmitter 212 includes a $T_R$ amplifier/attenuator 218 configured for tuning power of the polarized signals transmitted to the linearly polarized antenna element AE.

In this non-limiting example, the operational module 200 also includes a duplexer 166 coupled to the receiver 164 and to the transmitter 165. The duplexer 220 which isolates the receiving channel RC from the transmitting channel TC, while permitting them to share the common antenna element AE. For example, the duplexer 166 can be implemented as a switch. Alternatively, the duplexer 220 can be implemented as a circulator.

It should be understood that by supplying a suitable phase shift and amplitude to each of the antenna elements, the entire antenna beam produced by the antenna array can be of any desired polarization and power. Reference is made to FIGS. 5A-5E and FIGS. 6A-6D illustrating simulation results for the performance of the antenna device according to the invention. Here, FIGS. 5A-5B and 5C-5E correspond to the antenna device utilizing an antenna unit configuration of FIGS. 2A-2B; and FIGS. 6A-6B and 6C-6D correspond to the antenna device utilizing an antenna unit configuration of FIG. 2C.

More specifically, the simulation results illustrated in FIGS. 5A-5E correspond to the antenna unit configuration of FIGS. 2A-2B with the following parameters: the platform diameter of 4.2λ, the antenna element length and width of 4.4λ and 0.5λ respectively, and the distance d between the end of the platform and the antenna unit (first array) of 2.1λ. The simulation illustrated in FIGS. 6A-6D correspond to the antenna unit configuration of FIG. 2C with the following parameters: the platform diameter of 3.8λ, the antenna element length and width of 1.2λ and 0.5λ respectively, the distance d between the end of the of platform and the antenna unit (first array) of 2.1λ, and the distance c between the first and second antenna arrays of 1.4λ.

Figure 5A:
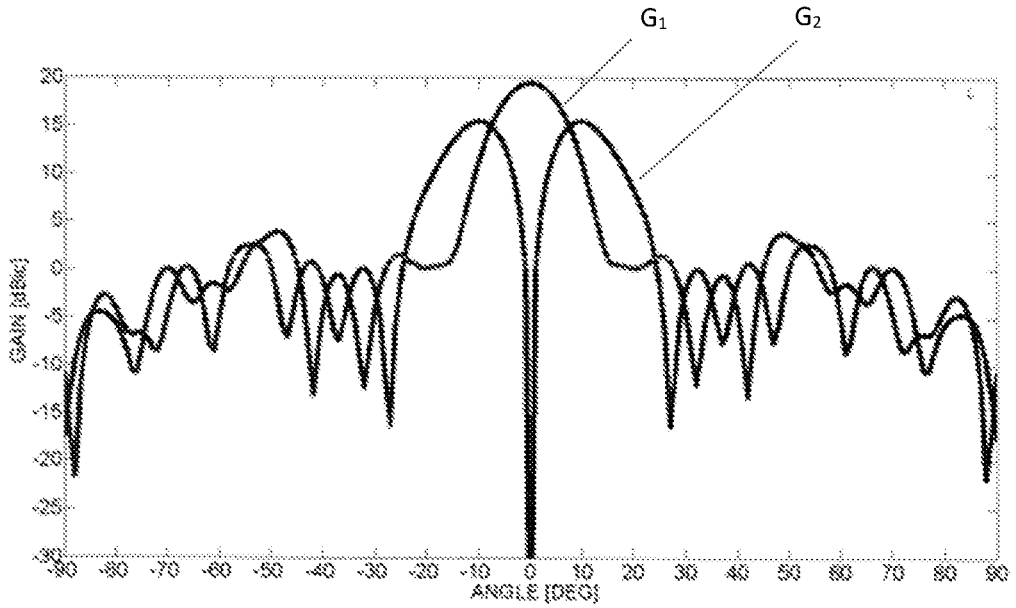
FIGS. 5A-5B and 5C-5E exemplify simulation results for the performance of the antenna device of the invention utilizing an antenna unit configuration of FIG. 1, for respectively zero-degree and 10 degree angular orientations of the antenna boresight.
Figure 5B:
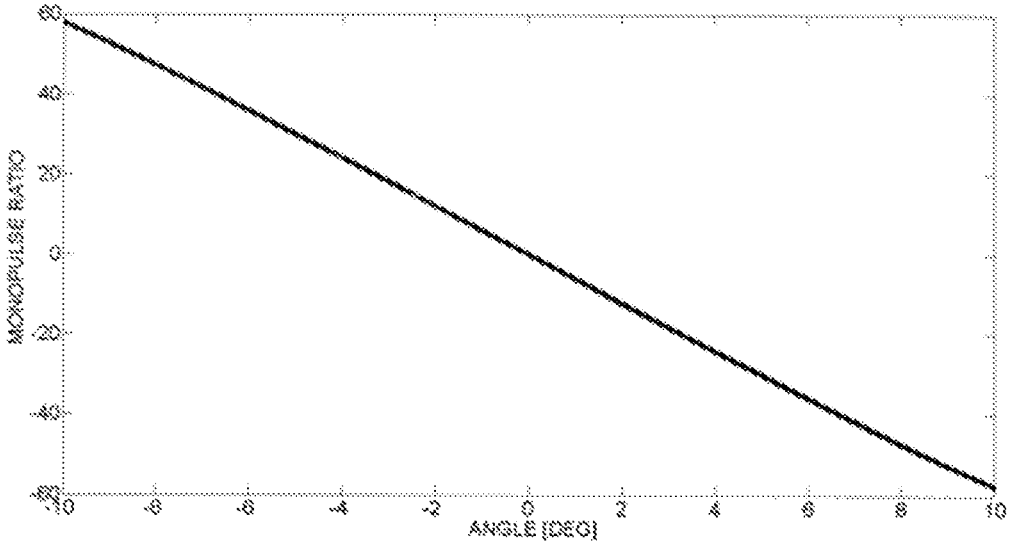

FIG. 5A exemplifies simulation of the antenna unit operation (in a receiving mode), and shows the sum signal pattern versus azimuth angle of a target (graph $G_1$) and the azimuth difference signal pattern versus azimuth angle of a target (graph $G_2$), in the azimuth plane, when the boresight angle is substantially zero, the antenna received signals have circular polarization. It should be understood that for the antenna operation in a transmitting mode, there is no such azimuth difference signal pattern vs azimuth angle, while the sum signal pattern vs azimuth angle is substantially the same as for the receiving mode operation. FIG. 5B illustrates the dependencies of the monopulse ratio on the azimuth angle obtained for the transceiver elements (antenna elements) of the array that receive signals having circular polarization, when the antenna boresight angle is zero degrees.

Figure 5C:
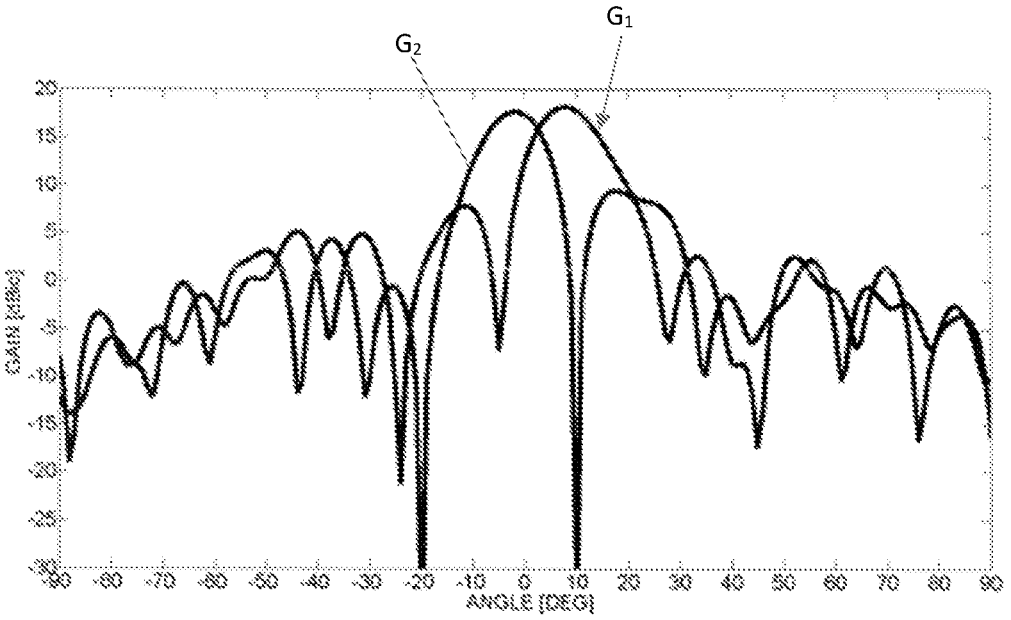
Figure 5D:
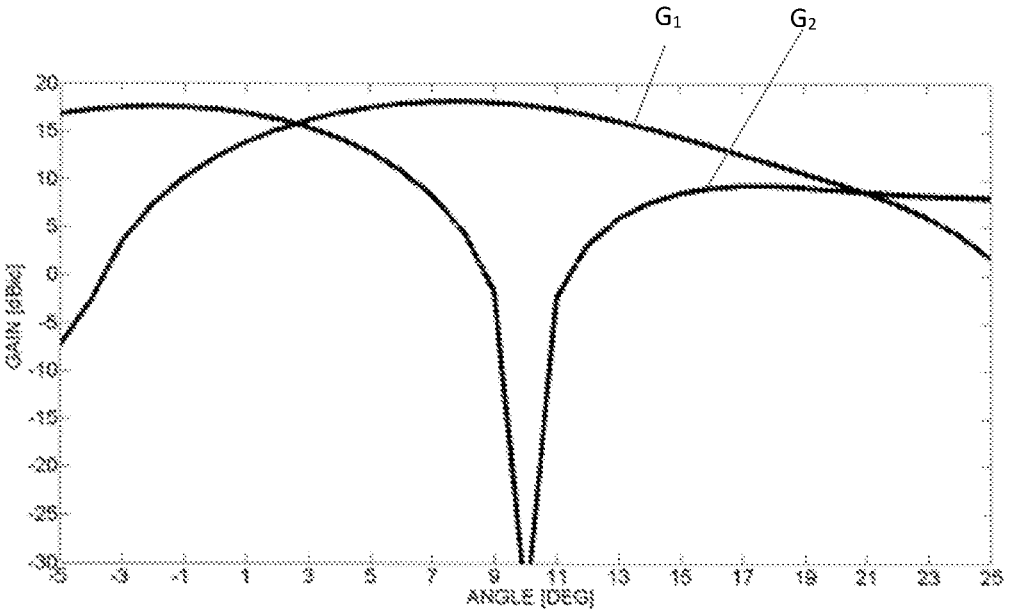
Figure 5E:
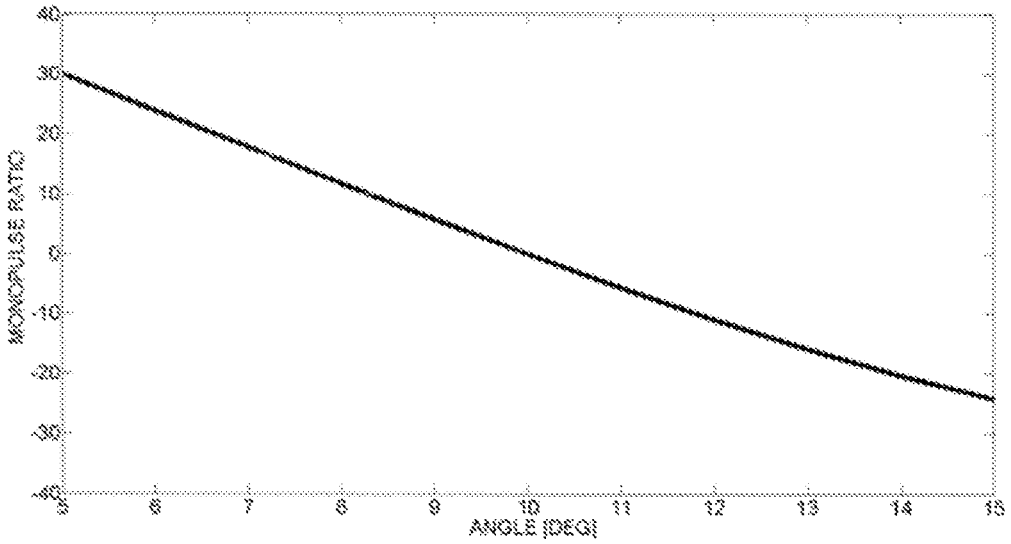

FIG. 5C exemplify simulation for the sum signal pattern (graph $G_1$) and the azimuth difference signal pattern (graph $G_2$) in the azimuth plane versus azimuth angle of a target, when the boresight angle is 10 degrees and the received signal have circular polarization. FIG. 5D is a zoom on the specific angular segment of the graphs in FIG. 5C. FIG. 45E shows dependencies of the monopulse ratio on the azimuth angle obtained for the transceiver elements of the array that receive signals having circular polarization, when the antenna boresight angle is at 10 degrees orientation.

Figure 6A:
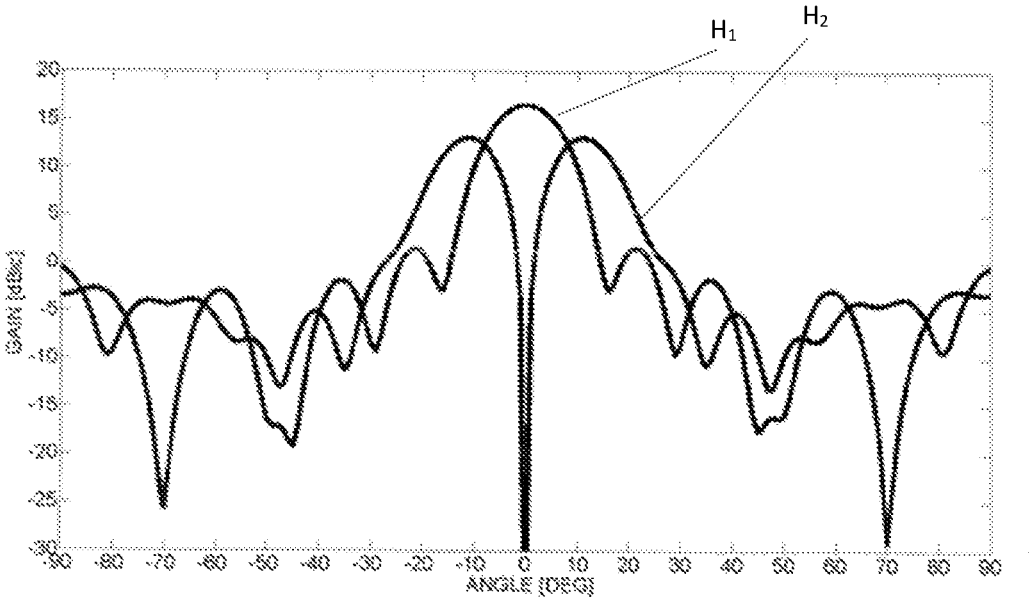
FIGS. 6A-6D exemplify simulation results for the performance of the antenna device of the invention utilizing an antenna unit configuration of FIG. 2 for zero-degree orientation of the antenna boresight.
Figure 6B:
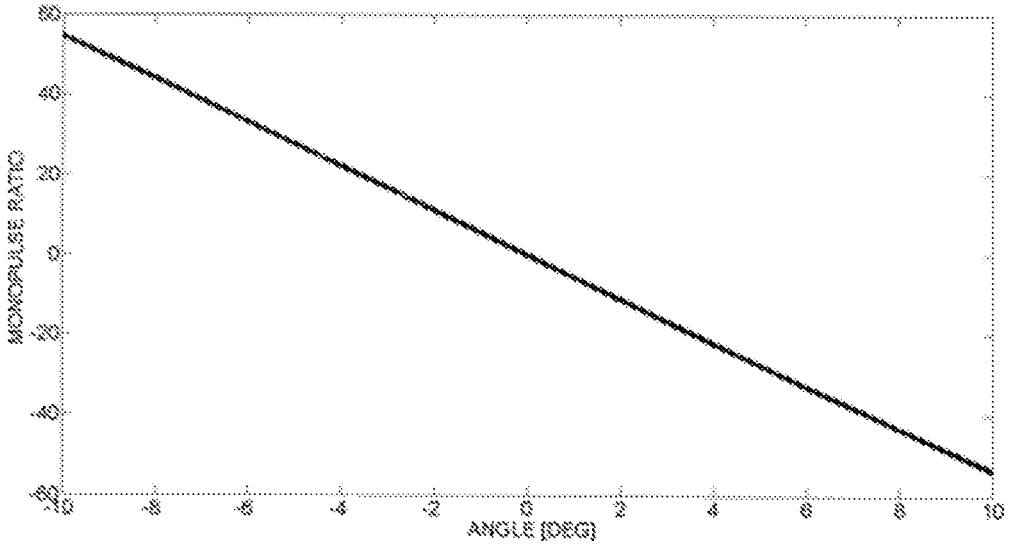
Figure 6C:
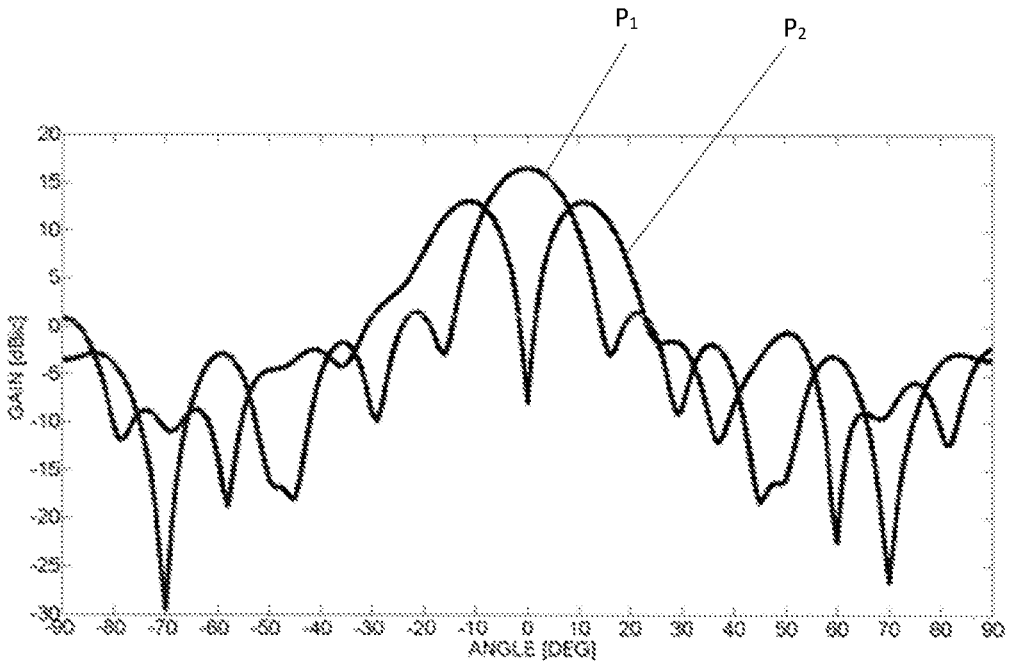
Figure 6D:
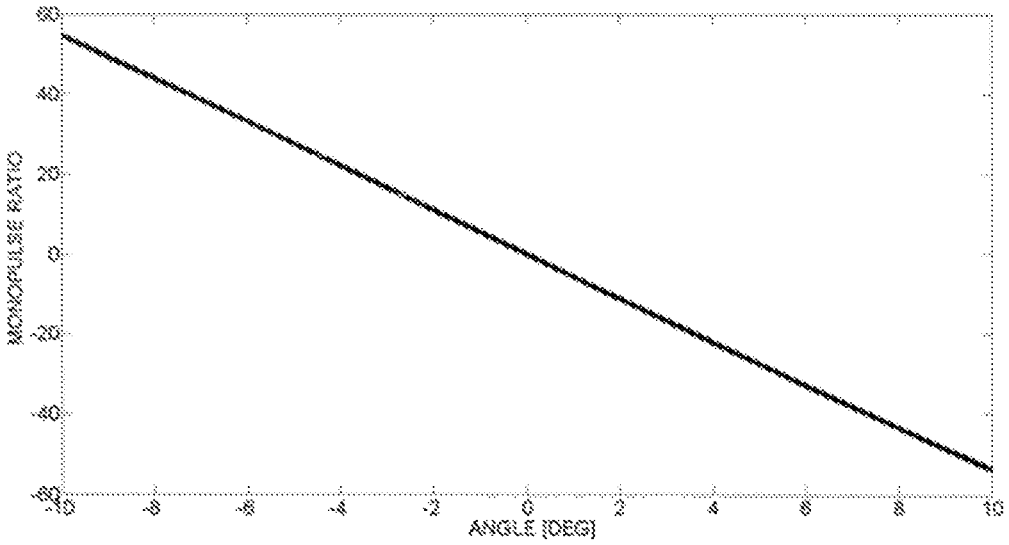

FIGS. 6A and 6B show the sum signal pattern (graph $H_1$) and the azimuth difference signal pattern (graph $H_2$) in the azimuth plane versus azimuth angle of a target (FIG. 6A), and the dependencies of the monopulse ratio on the azimuth angle (FIG. 6B), for the circular polarization and the zero angle of boresight orientation. FIGS. 6C and 6D show similar results in the elevation plane, for the circular polarization and the zero angle of boresight orientation: FIG. 6C shows the sum signal pattern in the elevation plane versus elevation angle of a target (graph $P_1$), and the elevation difference signal pattern in the elevation plane versus elevation angle of a target (graph $P_2$), and FIG. 6D shows the dependencies of the monopulse ratio on the elevation angle.

Thus, by using the above described configuration and operation of the antenna unit, all the antenna elements, as well as the radiating portion of the antenna body, positively contribute to the antenna pattern in each selected radiation direction within the wide angular range of steering. The present invention advantageously provides for maximizing the performance of the conformal antenna for the forward-looking operation, with the electronic steering within the wide angular range (i.e. such that all the antenna elements contribute in the antenna pattern for each angular direction), for a wide frequency band. The antenna device can operate in high-temperature environmental conditions. The antenna can be incorporated in a metallic body. The antenna device of the present invention can be mounted on a small-diameter platform body. The antenna device of the invention may be used without a radome, which significantly simplifies the device configuration. The conformal antenna device of the present invention can be used in any communication and telemetric application, being mounted on a suitable platform.

The invention claimed is:

1. An antenna device, comprising:

a conformal antenna body which has a selected geometry corresponding to a front portion of a platform having a platform nose on which the antenna device being mounted; and an antenna unit carried by the conformal antenna body, the antenna unit including at least one phased array of antenna elements, the antenna elements of said at least one phased array being arranged in a spaced-apart relationship in a closed loop path along a circumference of the conformal antenna body having a proper geometry corresponding to a front portion of platform on which the antenna unit being mounted, wherein:

each of the antenna elements of said at least one phased array is configured as an elongated end-fire antenna element having a boresight parallel to the elongated surface thereof and being capable of emitting linearly polarized radiation;

each of the end-fire antenna elements of said at least one phased array extends along a longitudinal axis of the body;

each of the end-fire antenna elements of said at least one phased array is associated with a respective operational module comprising a phase shifting utility; and the entire phased array of the end-fire antenna elements being operable as a forward looking end-fire antenna array producing an antenna beam in a generally forward-looking direction relative to the platform nose, enabling electronic steering of the antenna beam produced by the entire phased array by controllably modifying phases of the antenna elements of the phased array to provide a predetermined phase pattern of a proper radiating beam in accordance with a selected radiation direction around said generally forward-looking direction.

2. The antenna device according to claim 1, wherein the conformal antenna body has a cylindrical shape, the antenna unit being spaced a predetermined distance from a base region of the cylindrical antenna body.

3. The antenna device according to claim 1, wherein the conformal antenna body has a conical shape, the antenna unit being spaced a predetermined distance from an apex region of the conformal antenna body.

4. The antenna device according to claim 1, wherein the conformal antenna body is configured as at least a part of a spherical shape.

5. The antenna device according to claim 1, wherein the conformal antenna body has a distal conical portion and a proximal tubular portion, the antenna elements of said at least one phased array being arranged in at least one of the distal or proximal portions of the conformal antenna body, being spaced a predetermined distance from an apex region of the conical distal portion.

6. The antenna device according to claim 1, wherein the antenna unit includes two or more of the antenna arrays arranged in a spaced-apart relationship along a longitudinal axis of the conformal antenna body.

7. The antenna device according to claim 6, wherein adjacent antenna elements of the two or more of the antenna arrays are arranged in a chess-like fashion.

8. The antenna device according to claim 1, further comprising a phase control circuit in communication with the operational modules of the antenna elements for controlling phases of all the antenna elements of each of the at least one phased array of the end-fire antenna elements to provide a predetermined phase pattern providing a proper radiating beam of the antenna unit in accordance with a selected radiation direction.

9. The antenna device according to claim 8, wherein the phase control circuit is configured and operable to selectively carry out one of the following:

(i) for each radiation direction in an angular range from about zero up to about 40 degrees of radiation directions, providing a predetermined phase pattern of the at least one phased array of the end-fire antenna elements resulting in a circular polarization of the antenna radiation of said antenna elements; or (ii) for each radiation direction in an angular range of about 40 degrees or higher, providing a predetermined phase pattern of the at least one phased array of the end-fire antenna elements resulting in circular or arbitrary linear polarization of the antenna radiation.

10. The antenna device according to claim 8, wherein the phase control circuit is configured and operable to provide a predetermined phase pattern of the at least one phased array of the end-fire antenna elements for each radiation direction in an angular range from about zero up to about 40 degrees of radiation directions, said phase control circuit operating to shift the phases of the end-fire antenna elements in the phased array one with respect to the other along a circular direction, such that each successive antenna element in said direction has a phase shifted by a predetermined value with respect to a preceding antenna element, resulting in a circular polarization of the antenna radiation of said antenna elements.

11. The antenna device according to claim 10, wherein the phases of all the end-fire antenna elements in the phased array are controlled to be similar, for each radiation direction in an angular range from about zero up to about 40 degrees of radiation directions.

12. The antenna device according to claim 8, wherein the phases of the end-fire antenna elements in the phased array are shifted by a phase shift $\Delta\varphi$ between each two successive antenna elements in the antenna array of n elements array a value determined as $\Delta\varphi=2\pi/n$.

13. The antenna device according to claim 8, wherein the phases of all the antenna elements are controlled to be similar, for each radiation direction in an angular range of about 40 degrees or higher, for circular or arbitrary linear polarization of the antenna radiation.

14. The antenna device according to claim 1, further comprising an additional antenna unit comprising one or more phase arrays of antenna elements configured with a boresight perpendicular to a longitudinal axis of the conformal antenna body.

15. The antenna device according to claim 1, wherein each of said elongated end-fire antenna elements having the boresight parallel to the elongated surface thereof is configured as an end-fire waveguide dimensioned for propagating two orthogonal linearly polarized wave energy modes.

16. The antenna device according to claim 1, wherein each of said elongated end-fire antenna elements having the boresight parallel to the elongated surface thereof is configured to produce a radiation beam whose axis is either parallel to the longitudinal axis of the antenna element or makes an angle with said longitudinal axis other than 90 degrees.

17. The antenna device according to claim 1, wherein each of said at least one phased array formed by said elongated end-fire antenna elements having the boresight parallel to the elongated surface thereof is configured and operable such that all the antenna elements in said array emit radiation contributing to the predetermined phase pattern of the radiating beam of the antenna array for each selected radiation direction around said generally forward-looking direction.

18. A sensing system, comprising:

an antenna device; and one or more additional sensor device comprising at least one of optical and RF sensor elements;

wherein the antenna device includes:

a conformal antenna body which has a proper geometry corresponding to a front portion of a platform having a platform nose on which the antenna device is to be mounted; and an antenna unit carried by the conformal antenna body, the antenna unit comprising at least one phased array of antenna elements, the antenna elements of each of said at least one phased array being arranged in a spaced-apart relationship in a closed loop path along a circumference of the conformal antenna body having a proper geometry corresponding to a front portion of platform on which the antenna unit is to be mounted, wherein:

each of the antenna elements of said at least one phased array is configured as an elongated end-fire antenna element having a boresight parallel to the elongated surface thereof and being capable of emitting linearly polarized radiation;

each of the end-fire antenna elements of said at least one phased array extends along a longitudinal axis of the body; and each of the end-fire antenna elements of said at least one phased array is associated with a respective operational module comprising a phase shifting utility, the entire phased array of the end-fire antenna elements being operable as a forward looking end-fire antenna array producing an antenna beam in a generally forward-looking direction relative to the platform nose, enabling electronic steering of the antenna beam produced by the entire phased array by controllably modifying phases of the antenna elements of the phased array to provide a predetermined phase pattern of a proper radiating beam in accordance with a selected radiation direction around said generally forward-looking direction.

19. A platform having a front portion defining a platform nose, the platform comprising:

an antenna device mounted on said front portion; the antenna device including:

a conformal antenna body which has a proper geometry corresponding to a front portion of a platform having a platform nose on which the antenna device is to be mounted; and an antenna unit carried by the conformal antenna body, the antenna unit comprising at least one phased array of antenna elements, the antenna elements of said at least one phased array being arranged in a spaced-apart relationship in a closed loop path along a circumference of the conformal antenna body having a proper geometry corresponding to a front portion of platform on which the antenna unit is to be mounted, wherein:

each of the antenna elements of said at least one phased array is configured as an elongated end-fire antenna element having a boresight parallel to the elongated surface thereof and being capable of emitting linearly polarized radiation;

each of the end-fire antenna elements of said at least one phased array extends along a longitudinal axis of the body; and each of the end-fire antenna elements of said at least one phased array is associated with a respective operational module comprising a phase shifting utility, the entire phased array of the end-fire antenna elements being operable as a forward looking end-fire antenna array producing an antenna beam in a generally forward-looking direction relative to the platform nose, enabling electronic steering of the antenna beam produced by the entire phased array by controllably modifying phases of the antenna elements of the phased array to provide a predetermined phase pattern of a proper radiating beam in accordance with a selected radiation direction around said generally forward-looking direction.

* * * * *